US006630027B2

(12) United States Patent
Pawlo

(10) Patent No.: US 6,630,027 B2
(45) Date of Patent: Oct. 7, 2003

(54) DEVICE FOR DELIVERING CHARGED POWDER FOR DEPOSITION

(75) Inventor: George R. Pawlo, Long Valley, NJ (US)

(73) Assignee: Delsys Pharmaceutical Corporation, Monmouth Junction, NJ (US)

( * ) Notice: Subject to any disclaimer, the term of this patent is extended or adjusted under 35 U.S.C. 154(b) by 0 days.

(21) Appl. No.: 09/903,397

(22) Filed: Jul. 11, 2001

(65) Prior Publication Data

US 2002/0043212 A1 Apr. 18, 2002

Related U.S. Application Data

(60) Provisional application No. 60/217,260, filed on Jul. 11, 2000.

(51) Int. Cl.[7] ..... B05C 5/02
(52) U.S. Cl. ..... 118/621; 118/623
(58) Field of Search ..... 118/621, 640; 427/472, 474, 475

(56) References Cited

U.S. PATENT DOCUMENTS 3,991,710 A * 11/1976 Gourdine et al. ..... 118/630
4,109,027 A * 8/1978 Crose ..... 118/621
4,314,669 A 2/1982 Moos
5,083,710 A 1/1992 McLoughlin et al.
5,213,271 A 5/1993 Uribe et al.
5,660,532 A * 8/1997 Castel ..... 417/342
6,143,082 A * 11/2000 McInerney et al. ..... 118/719
6,227,769 B1 5/2001 Wilson et al.
6,444,033 B1 * 9/2002 O'Mara et al. ..... 118/621

* cited by examiner

*Primary Examiner*—Richard Crispino
*Assistant Examiner*—Michelle Aewedo Lazor
(74) *Attorney, Agent, or Firm*—Dechert LLP

(57) ABSTRACT

Provided, among other things, is a re-circulating particle feed apparatus comprising: a circular conduit of dimensions suitable for circulating gas with suspended particles; a deposition station comprising an opening onto the conduit, into which opening an electrostatic chuck fits, with a deposition surface of the chuck available to the interior of the conduit; and a propulsion device for maintaining fluid and particle circulation through the conduit, wherein the propulsion device is adapted to maintain fluid and particle circulation at a rate that brings a deposition effective amount of particles within a range of electro-attractive influence at the deposition station.

15 Claims, 11 Drawing Sheets

DEVICE FOR DELIVERING CHARGED POWDER FOR DEPOSITION

This application claims the benefit of U.S. Provisional Application No. 60/217,260, filed Jul. 11, 2000.

The present invention relates to devices for delivering or electrostatically charging powder particles, especially for use in a device for electro-attractive deposition.

The inventors, or associates working with the inventors, have described a number of techniques and devices useful for applying measured amounts of particles onto a substrate. Such depositions make it possible to deposit controlled amounts of, for example, a pharmaceutical onto spatially resolved areas of a substrate. These techniques have typically deposited charged particles or grains onto a substrate mounted on a device, which can be called an electrostatic chuck, that provides the electrical field that attracts the particles or grains. The particles or grains are typically charged, though attraction can occur through polarizations of the particles or grains. The electrostatic chuck has electrode pads that are polarized to create the attractive force. Adjacent electrodes, of a different potential, can be used to shape the attractive field or steer particles or grains away from undesired locations. A cut-away view of one such electrostatic chuck is illustrated in FIG. 7. Once attracted to a given location, grains or particles can induce an image force in nearby conductors, which image force can be a powerful contributor to the forces retaining the grains or particles. Other retentive forces include other charge and charge redistribution induced forces, packing forces and Van der Waals forces.

Further improvements in the methods and devices used to delivery the particles to the substrate, and to charge the particles, are desirable, as tools to improve electro-attractive deposition, or provide further options for use in appropriate contexts. The inventors here provide new methods and devices for these purposes.

SUMMARY OF THE INVENTION

The invention provides a re-circulating particle feed apparatus comprising: a conduit (preferably circular) of dimensions suitable for circulating gas with suspended particles; a deposition station comprising an opening onto the conduit, into which opening an electrostatic chuck fits, with a deposition surface of the chuck available to the interior of the conduit; and a propulsion device for maintaining fluid and particle circulation through the conduit, wherein the propulsion device is adapted to maintain fluid and particle circulation at a rate that brings a deposition effective amount of particles within a range of electro-attractive influence at the deposition station.

Additionally, the invention provides a reciprocating particle feed apparatus comprising: a deposition chamber; a deposition station comprising an opening onto the deposition chamber, into which opening an electrostatic chuck fits, with a deposition surface of the chuck available to the interior of the conduit, the dimensions of the deposition chamber suitable for presenting a deposition effective amount of particles suspended therein within a range of electro-attractive influence at the deposition station; and at least one piston device comprising a piston and an expansion chamber connected to the deposition chamber, the piston device for maintaining particle suspension in the deposition chamber.

Further, the invention provides a particle feed apparatus comprising: a cylindrical deposition chamber having a center axis; and a deposition station comprising an opening onto the deposition chamber, into which opening an electrostatic chuck fits, with a deposition surface of the chuck available to the interior of the conduit, the dimensions of the deposition chamber suitable for presenting a deposition effective amount of particles suspended therein within a range of electro-attractive influence at the deposition station; wherein the center axis is centered with, and orthogonal to, the opening.

DETAILED DESCRIPTION OF THE INVENTION

Figure 1B:
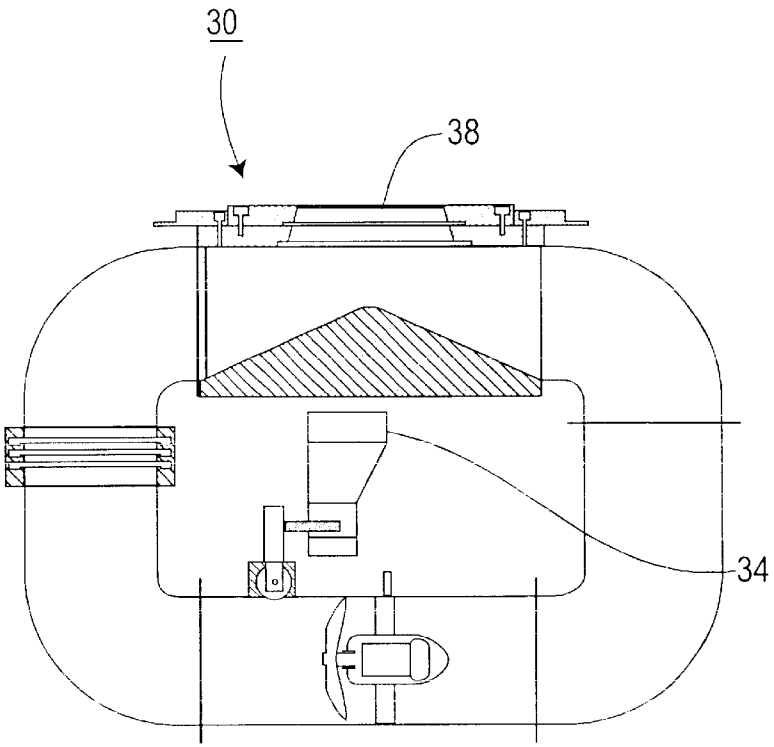
FIGS. 1A and 1B show two exemplary re-circulating particle feed apparatuses, with FIGS. 1C and 1D showing different views of the apparatus of FIG. 1A.
Figure 1A:
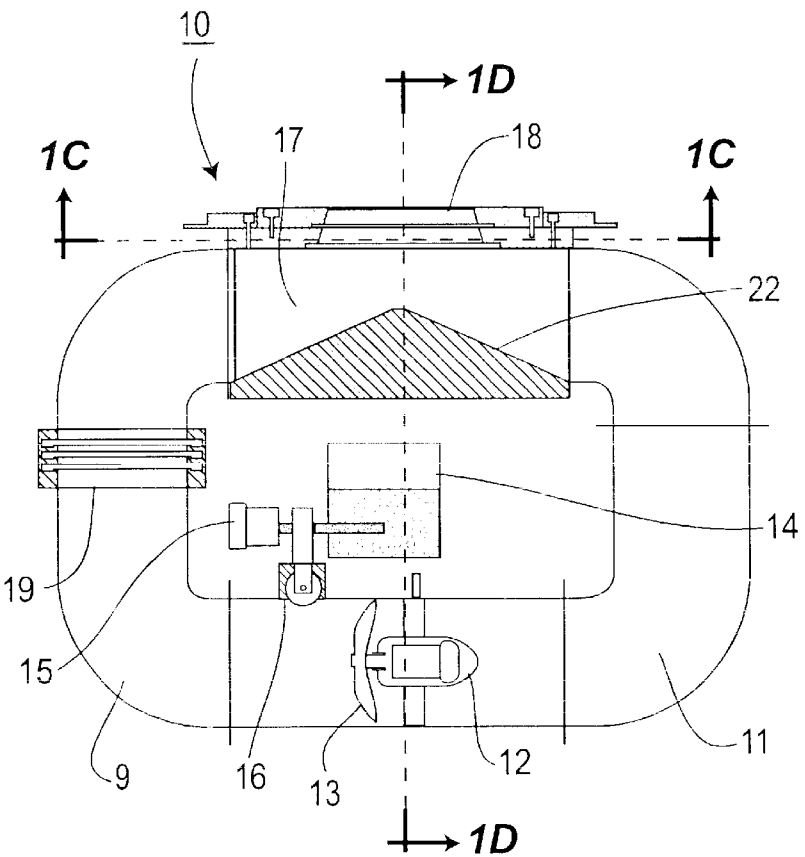
Figure 1D:
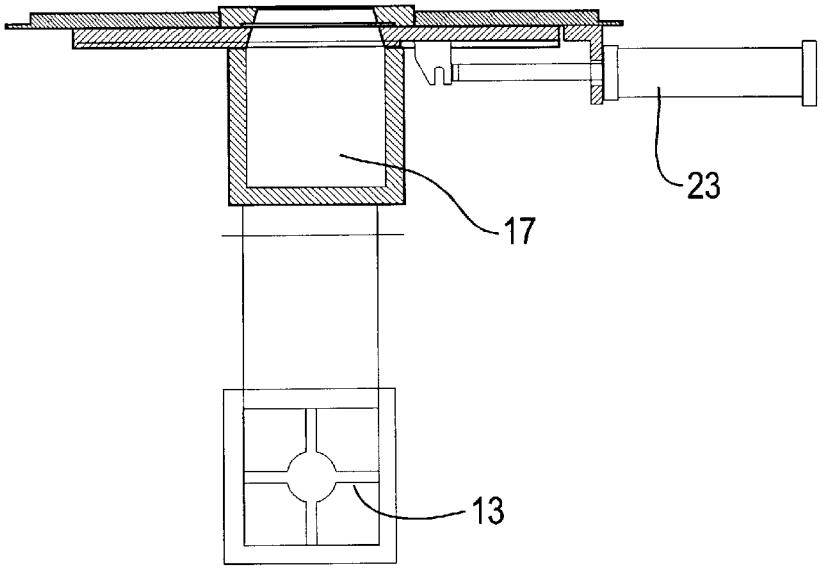
Figure 1C:
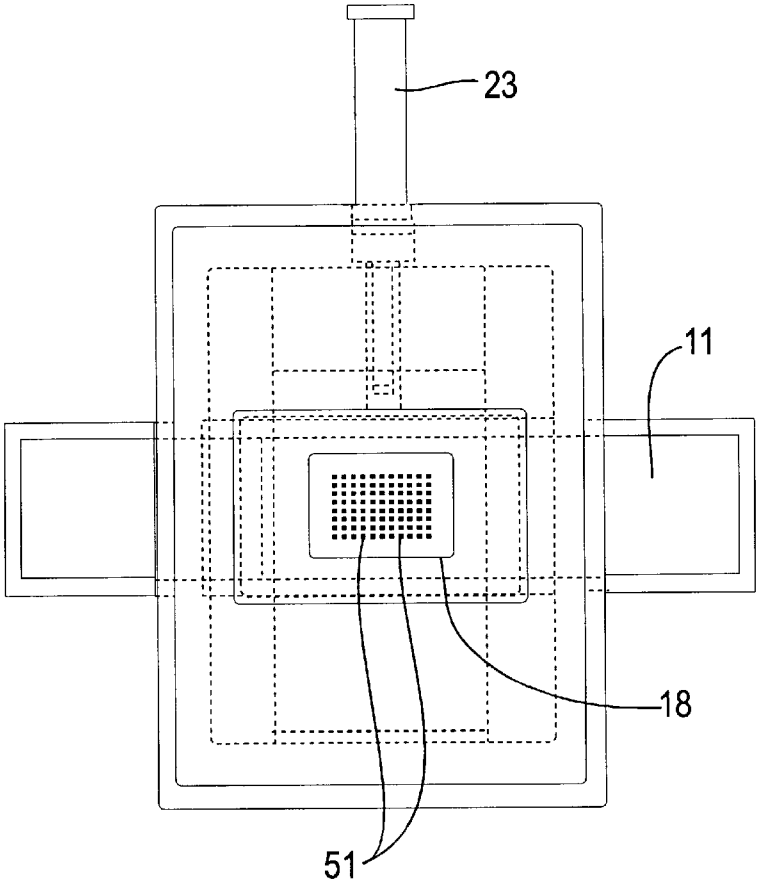

FIG. 1A shows an exemplary re-circulating particle feed apparatus 10 with a conduit 11, propulsion motor 12 and propelling blades 13 (the fan so provided can, of course be substituted with other propelling devices such as a turbine or appropriately valved piston devices). Particles are inserted into the conduit 11 through a loading device including fluidized bed 14, auger and auger motor device 15, and air-lock 16. The air-lock can comprise, for example, rotating vanes operating in a manner similar to a revolving door. Particles are propelled through the conduit to deposition chamber 17, at which is located deposition opening 18. Charging plates 19 can be connected to a source of electrical potential, providing a tool for charging the particles by induction charging. Diverting vane 22 operates to direct particles toward deposition opening 18. The deposition opening 18 can be closed by operating solenoid/actuator 23 (see, FIG. 1D), which moves a gate. FIG. 1C shows a top view of deposition opening 18, with the deposition electrodes 51 of an electrostatic chuck shown for context. (Note that the primary function of an electrostatic chuck is to attract charged particles to the chuck or a substrate layered onto the chuck. The chuck need not provide electrically-based adherence of a substrate.)

FIG. 1B shows another exemplary re-circulating particle feed apparatus 30 with a conduit 31, propulsion motor 32 and propelling blades 33. Particles are inserted into the conduit 31 through a loading device including hopper 34, auger device 35, and air-lock 36. Particles are propelled through the conduit to deposition chamber 37, at which is located deposition opening 38. Charging plates 39 or charging plate 41 can be connected to a source of electrical potential, providing a tool for charging the particles by induction charging.

It will be recognized that the particle charging elements exemplified in FIG. 1 can be substituted with other devices. For example, the conduit can further comprise a jet mill, with particle flow passing through the cyclone portion of the mill. A potential is applied to the mill, and particle flow though the mill is adapted to provide charge transfer-effective contact between the mill and the particles. Particles can exit the mill through an outlet at the center of the cyclone element (with the exit, for example, orthogonal to the circular flow within the cyclone).

Where fluid and particle flow is maintained by injected gas, a gas outlet must be attached to the fluid pathway (e.g., conduit 11). The outlet can be adapted, as is known in the art, to provide for exiting of gas and return to the re-circulating particle feed apparatus of the bulk of particles. Such return of particles can be through filtering, electrostatic precipitation, re-compression of the carrier gas, or the like. For safety, particles should be scrubbed from the exiting gas, for instance by electrostatic precipitation, use of cyclone separators, or filtering. One method of maintaining fluid and particle flow with injected gas uses a Venturi into which gas and suspended particles in the circuit are drawn and external gas is injected. Particles can be inserted into the conduit with the external gas injection.

When the re-circulating particle feed is operated without gas injections, such methodology provides direct re-cycling of particles and the simplification of avoiding scrubbing techniques for removing particles. With gas injections, re-circulating particle feed nonetheless provides for a substantial re-cycling advantage over systems that pass all of the bulk flow to scrubbing systems.

The gas flow rate through the conduit is selected to keep the particles sufficiently suspended to allow deposition at the deposition station, and preferably to minimize particle settling within the conduit. This flow rate will vary with the size and density of the particles.

Particles can be fed into the conduit in response to feedback data on the amount of particles flowing through the conduit or the amount of particles consumed in the deposition process. Sensing data can be obtained at one location, or two or more, such as before and after the deposition opening. An exemplary sensor is an optical sensor. The optical window or windows into the conduit (or mirror should light be returned to the optical window using a mirror) can be placed at a region of high turbulence, such as the outlet of a Venturi or a region that incorporates turbulence-creating elements (see below). The turbulence helps keep the windows or mirror free of adhered particles. Similarly, a constriction at the monitoring site can help keep the windows or mirror sufficiently clear by increasing the gas flow rate.

The gas in which the particles are suspended can be air or a purified gas, such as nitrogen or argon. Humidity control helps attain or maintain a desired charging and particle size distribution.

Figure 2A:
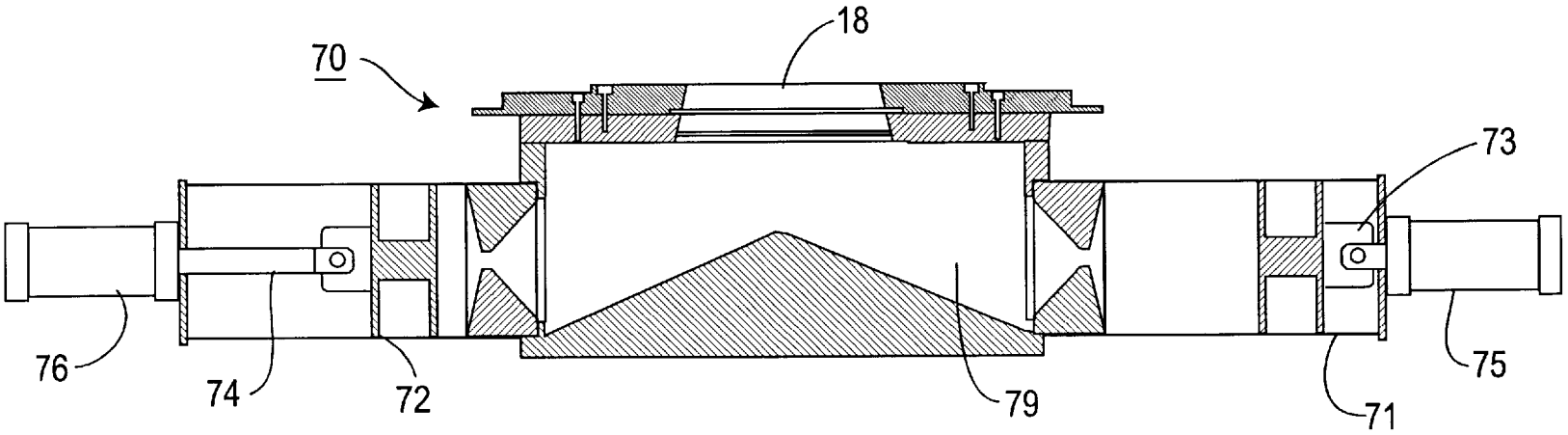
FIGS. 2A and 2B show different views of an exemplary reciprocating particle feed apparatus.
Figure 2B:
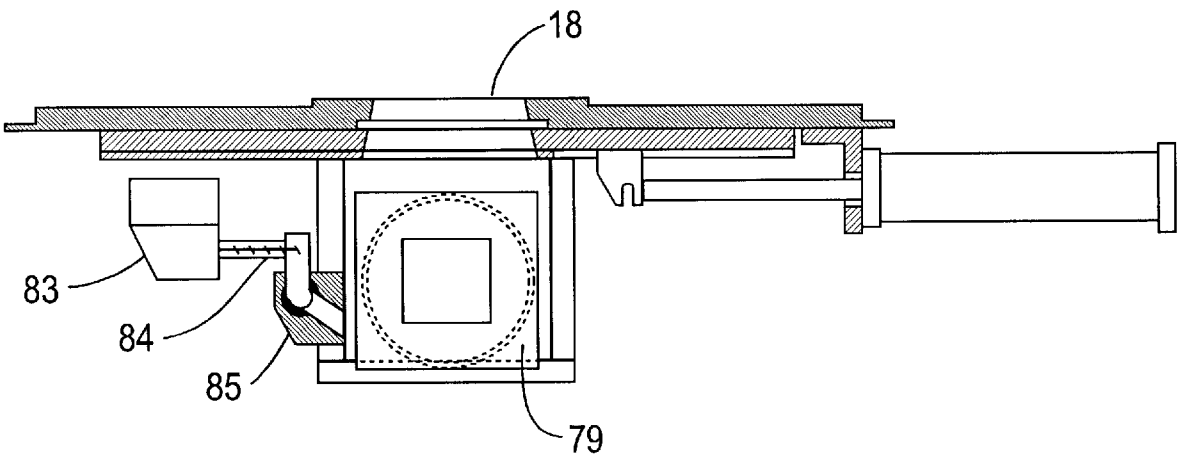

FIG. 2, particularly FIG. 2A, illustrates a reciprocating particle feed apparatus 70, with a first piston 71, first piston rod 73, first piston actuator 75, first expansion chamber 77 connected to a deposition chamber 79, second piston 72, second piston rod 74, second piston actuator 76, and second expansion chamber 78, also connected to the deposition chamber 79. Particles travelling between the expansion chambers and the deposition chambers can be charged by charging plates 82. Connected to deposition chamber 79 is deposition opening 81. Particles are inserted into the particle feed apparatus 70 through a loading device including hopper 83, auger device 84, and air-lock 85. It will be recognized that other powder delivery devices can be substituted, including devices that deliver already charged particles into the reciprocating particle feed apparatus 70.

Figure 3A:
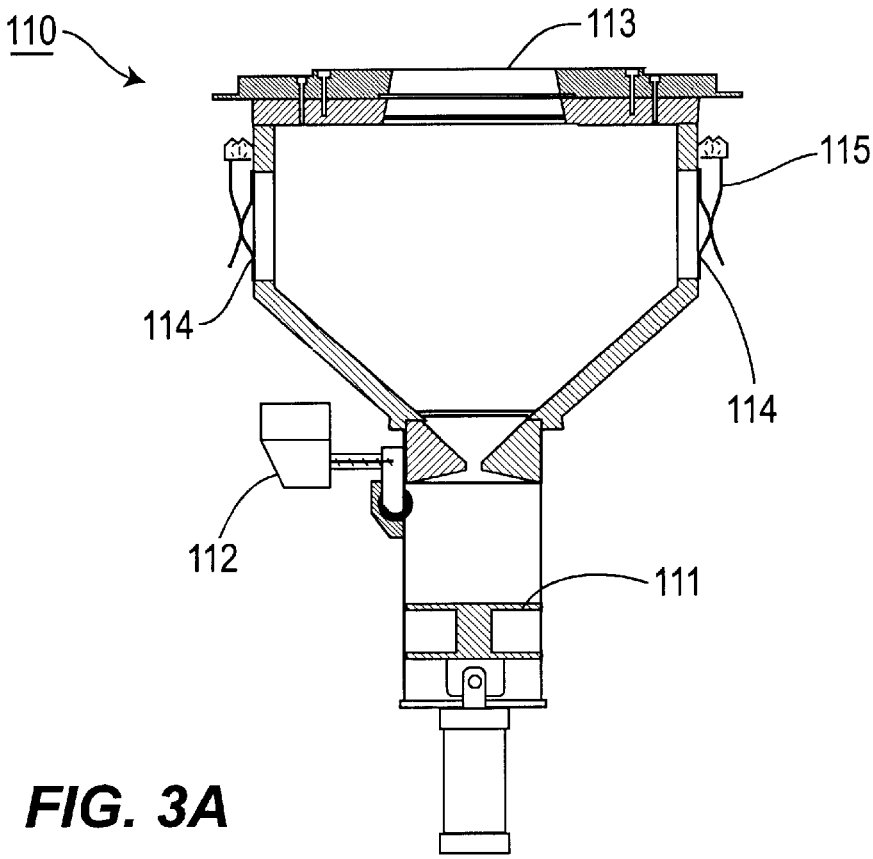
FIGS. 3A through 3C show other reciprocating particle feed apparatuses.
Figure 3B:
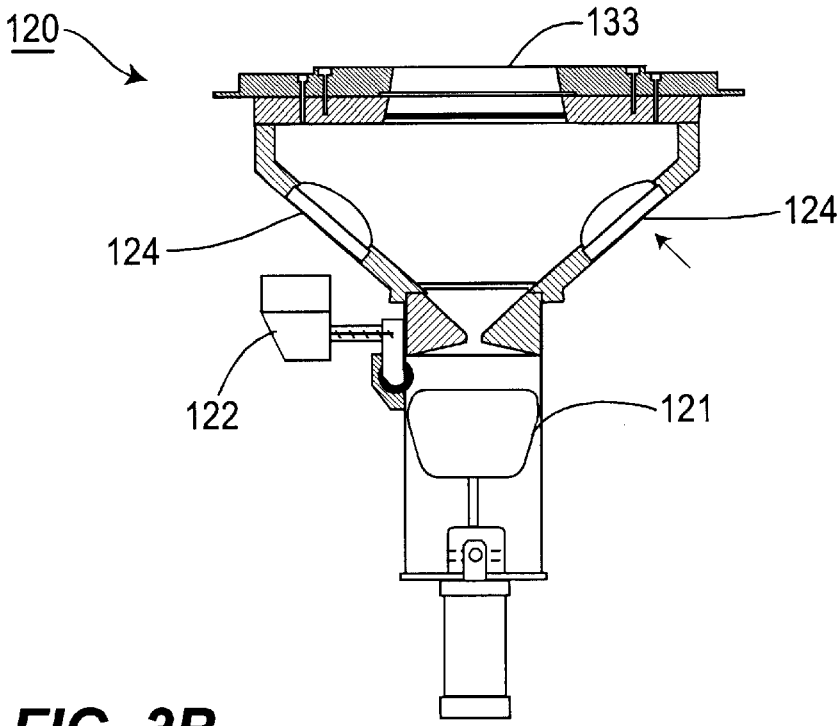
Figure 3C:
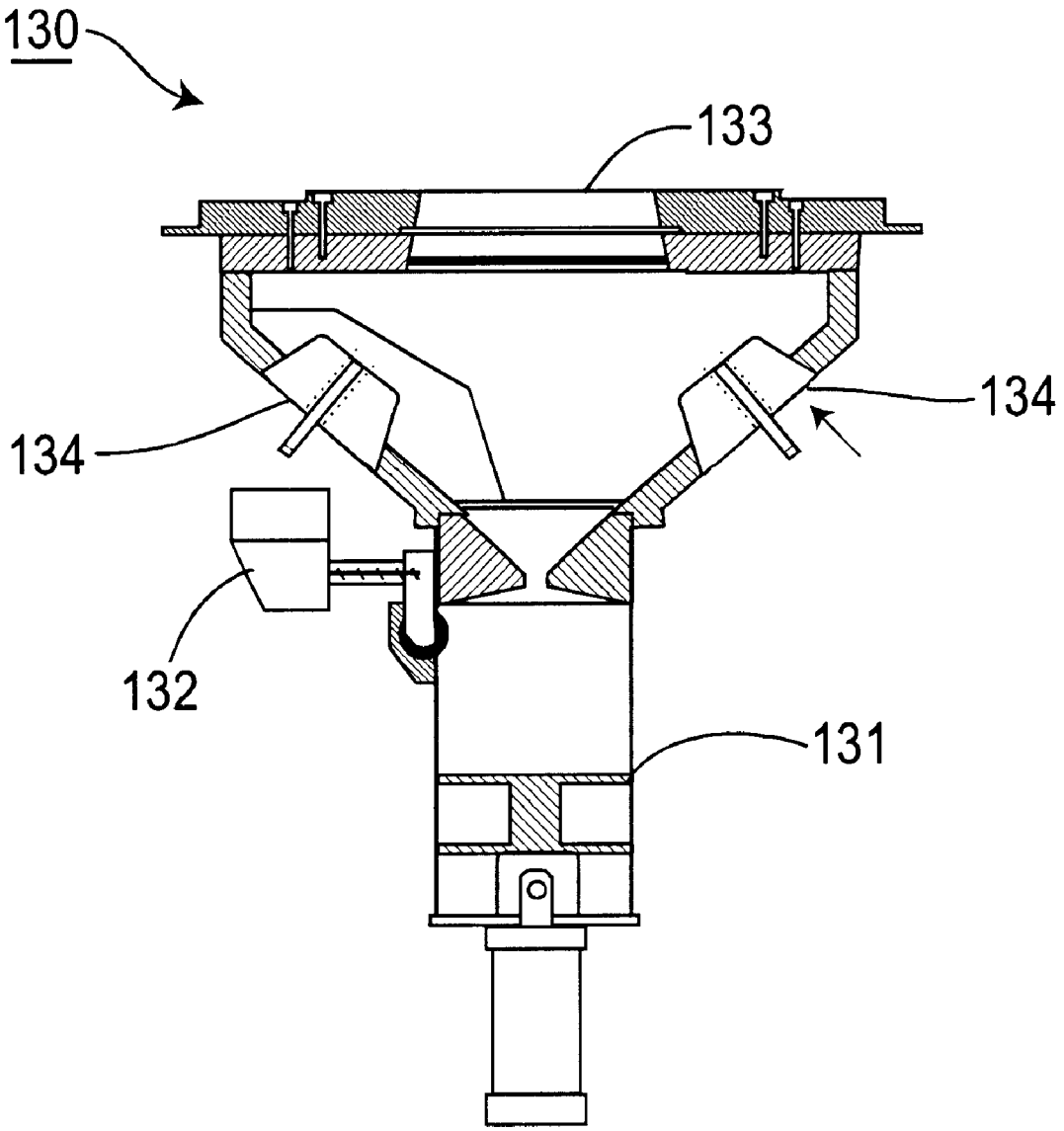

FIGS. 3A through 3C show further exemplary reciprocating particle feed apparatuses 110, 120 and 130. Shared features include deposition openings 113, 123 and 133, particle feed device 112, 122 and 132, and pistons 111, 121 and 131. Reciprocating particle feed apparatus 110 uses deflating dish diaphragms 114, with retention clips 115 Reciprocating particle feed apparatus 120 uses rolling diaphragms 124. Reciprocating particle feed apparatus 110 uses spring diaphragms 134.

Figure 4:
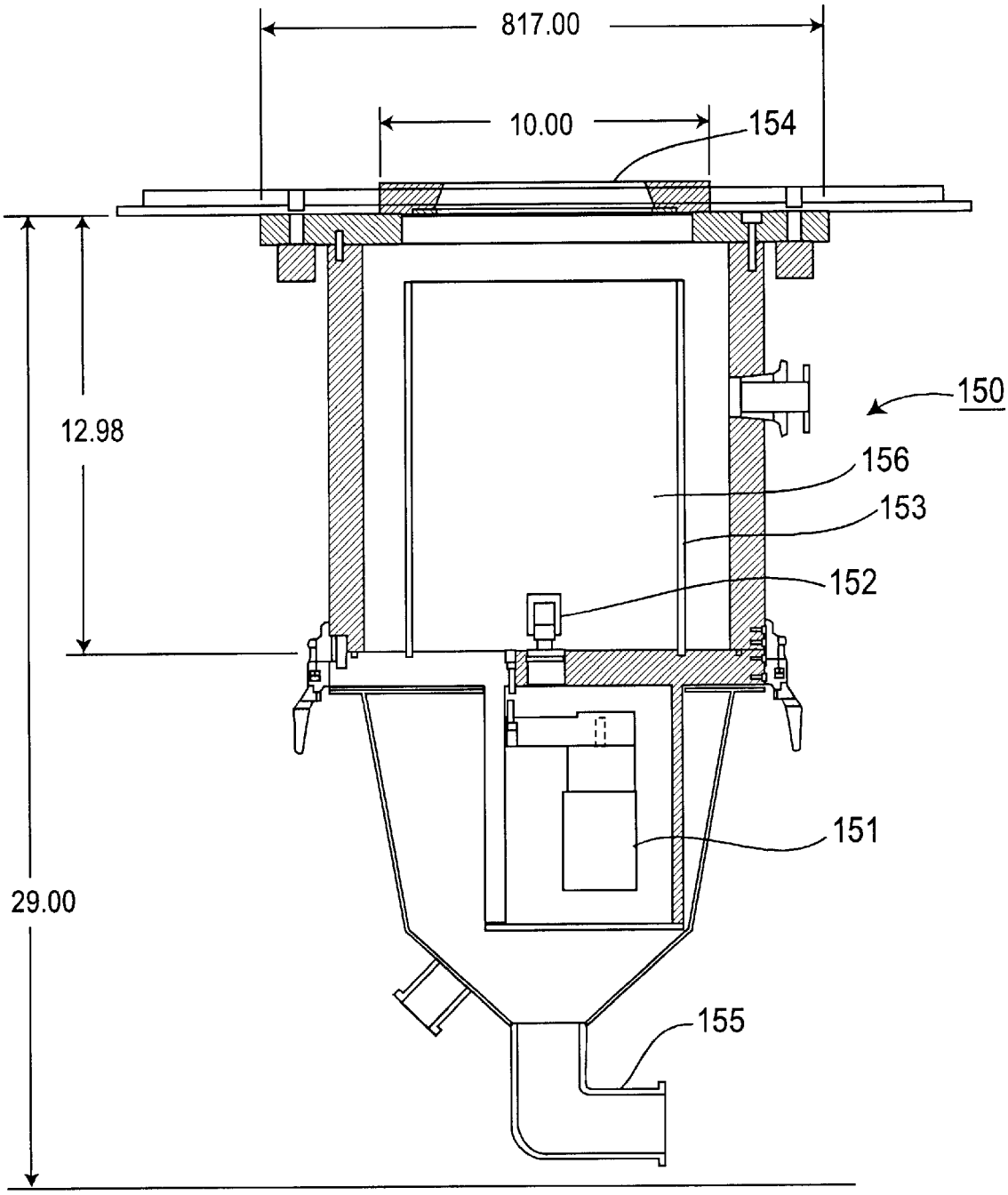
FIG. 4 illustrates a cylindrical particle feed apparatus.

FIG. 4 shows a particle feed apparatus 150 with a particle loading device 151 having a output nozzle 152, deposition chamber 156 with cylindrical walls 153, circular deposition opening 154, and particle return 155. The A-B axis is at the center of the cylinder and the deposition opening. Exemplary dimensions shown are in inches. The particle feed apparatus provides greater uniformity in particle flow characteristics, and allows laminar flow designs. Flow of gas and particles can be laminar or turbulent, or incorporate a combination of characteristics. Internal baffles or diffusers can be incorporated into the deposition chamber to direct powder flow towards the deposition opening at which a deposition substrate or electrostatic chuck is positioned.

Figure 6A:
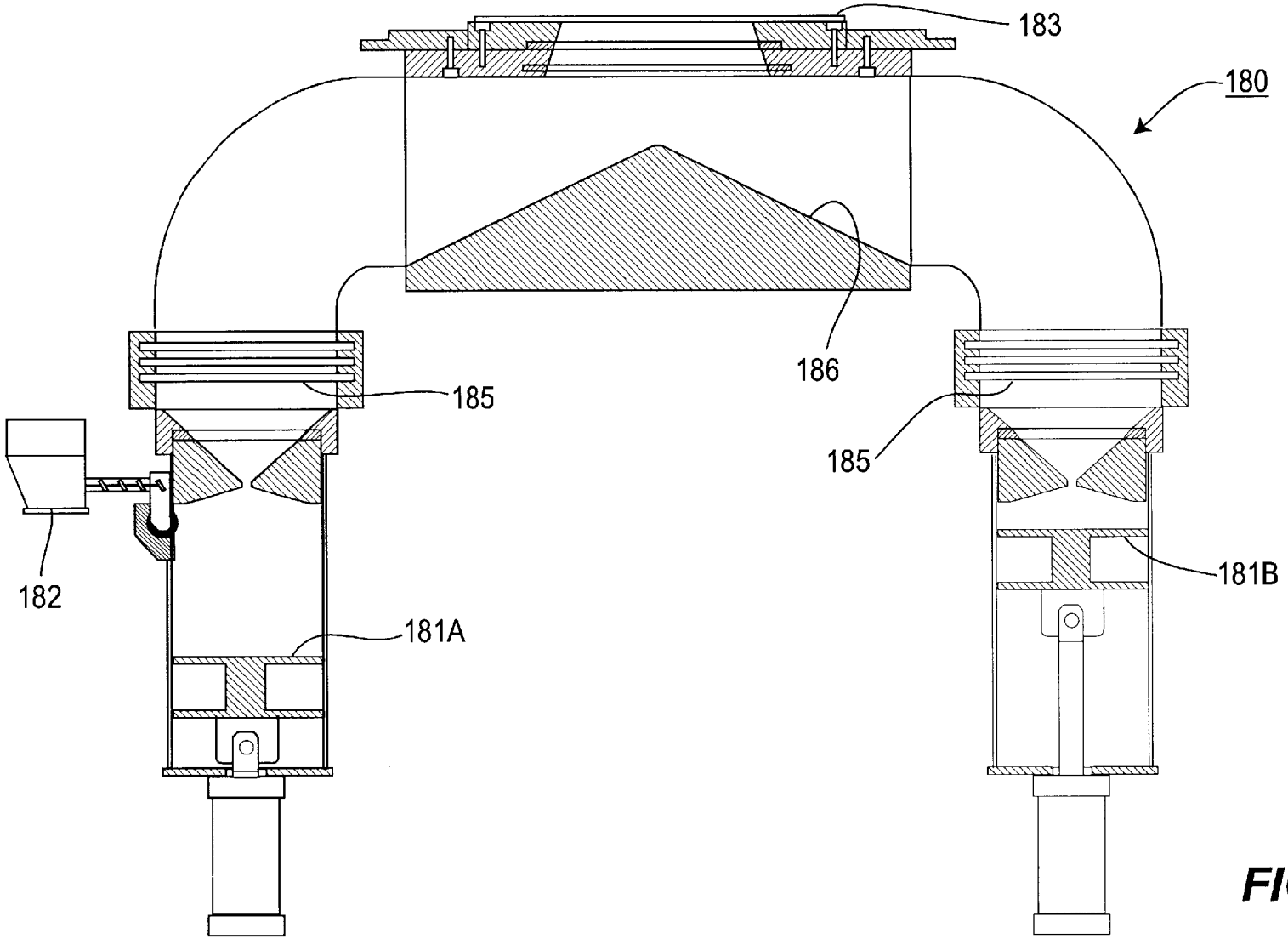
FIGS. 6A and 6B show further reciprocating particle feed apparatuses.
Figure 6B:
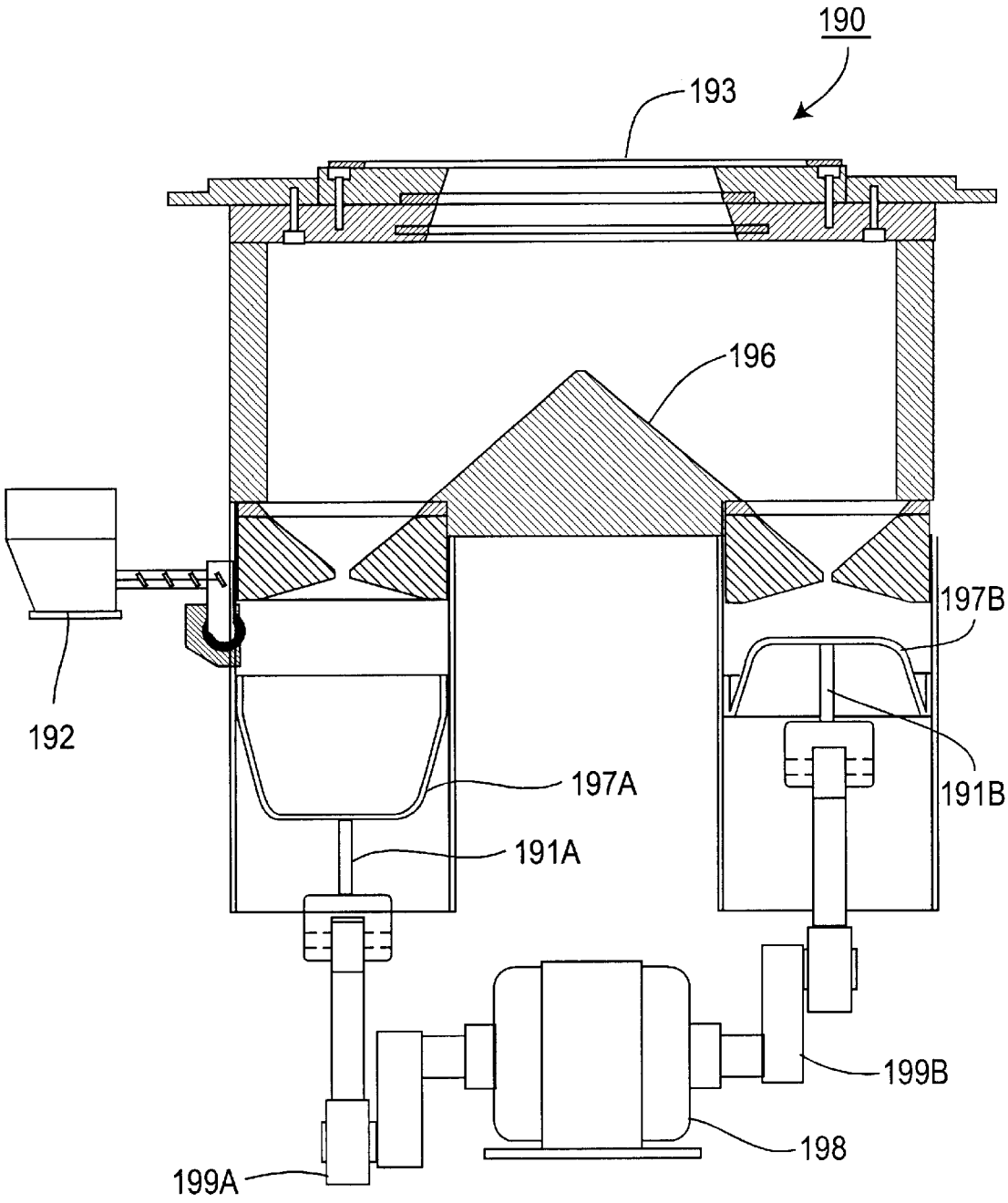

Two further reciprocating particle feed apparatuses are illustrated in FIG. 6A and FIG. 6B. Reciprocating particle feed apparatus 180 is powered by first piston 181A and second piston 181B, which operate pursuant to complementary, volume equalizing stroke patterns. Particle feed device 182 injects particles into the apparatus, where the piston strokes drive the particles past charging plates 185 (if present) and towards deposition opening 183. Diverting vane 186 directs particles toward the deposition opening 183. Reciprocating particle feed apparatus 190 is powered by first piston 191A and second piston 191B, which operate pursuant to complementary, volume equalizing stroke patterns. The pistons operate against first diaphragm 197A and second diaphragm 197B, respectively. The pistons are driven by motor 198, and reciprocally operating first gearing 199A and second gearing 199B. Particle feed device 192 injects particles into the apparatus, where the piston strokes drive the particles past charging plates 195 (if present) and towards deposition opening 193. Diverting vane 196 directs particles toward the deposition opening 193.

Figure 5:
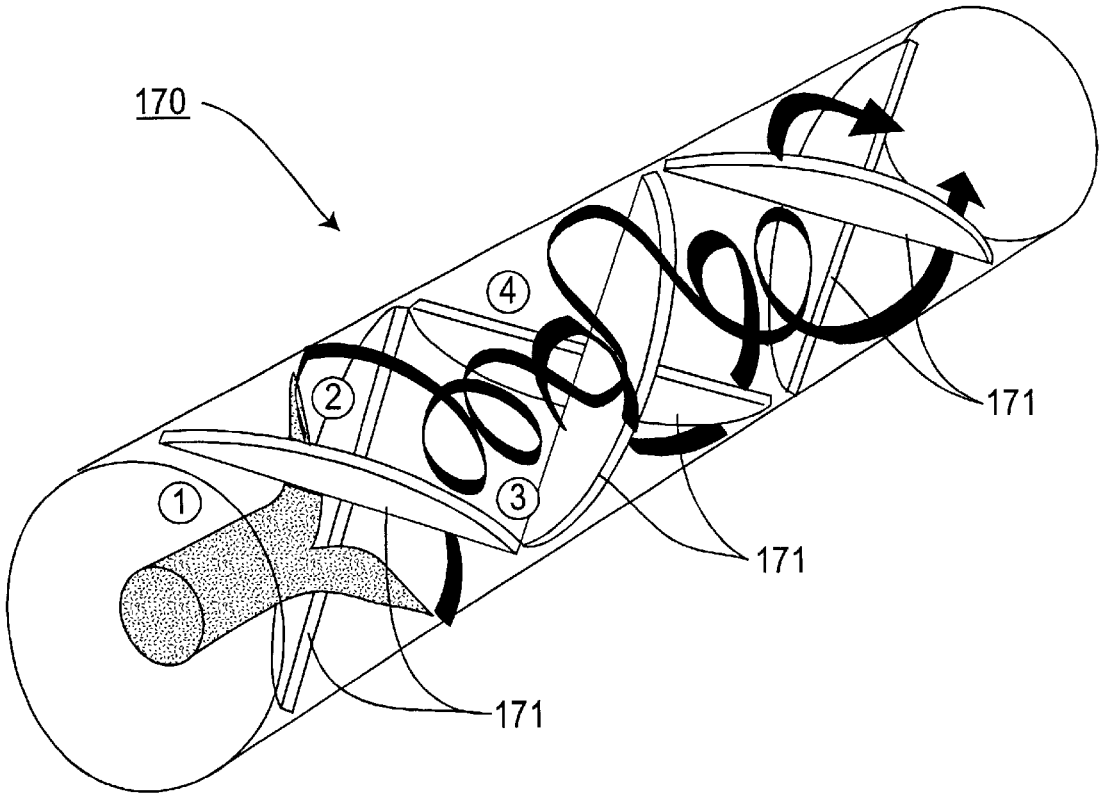
FIG. 5 displays an exemplary particle charging device.

FIG. 5 shows a segment of particle charging tubing 170 used in tribocharging (by collisions with surfaces in the tubing) particles or induction charging (by particles collecting charge from surfaces in the tubing) particles. Inserted into the particle charging tubing are turbulence-creating elements (e.g., bow-tie or static mixer elements) 171. The turbulence-creating elements 171 create vortexes that bring more particles in contact with, or into the vicinity of, the charging surfaces. The charging surfaces can include the surfaces of the turbulence-creating elements 171. An advantage that can be obtained with this aspect of the invention is greater uniformity in the q/m ratio of the particles and higher charge levels. Other charging methods beyond triboelectric charging and induction charging can be used, including corona charging, thermionic or field emission charging. "Corona charging" is familiar to those skilled in the art. See, for example, J. A. Cross, *Electrostatics: Principles, Problems and Applications,* IOP Publishing Limited (1987), pp. 46–49. See, also, for example, Branch et al., U.S. Pat. No. 6,246,852, which describes a grid electrode for corona charging particles.

Appropriate tribocharging materials include polyethylene, polycarbonate, stainless steel, and other materials in the triboelectric series typically defined by the endpoint materials teflon and nylon. For a typical triboelectric series table, see page 30, "Electrostatics Principles, Problems and Applications", by J A Cross, published by Adam Hilger and Bristol, 1987. Such materials can be selected for their efficiency in charging, and in charging to the desired polarity, the particular particles sought to be charged. In some instances, with conductive particles, the extra contacting induced with the invention can reduce the final charge of the particles (which is often, but not always, undesirable). This reduction can result from charge bleeding from the conductive particles. For induction charging, the charging surfaces are typically conductors that are coupled to a source of electrical potential.

The static mixer can be substituted with any turbulence-causing insert into the tubing, such as a wire mesh. Such inserts can be seated at junctions in the tubing, such as junctions joined by mechanical fitting devices, such as those available from Swaglok brand pipe fittings available from numerous supply companies.

Figure 7:
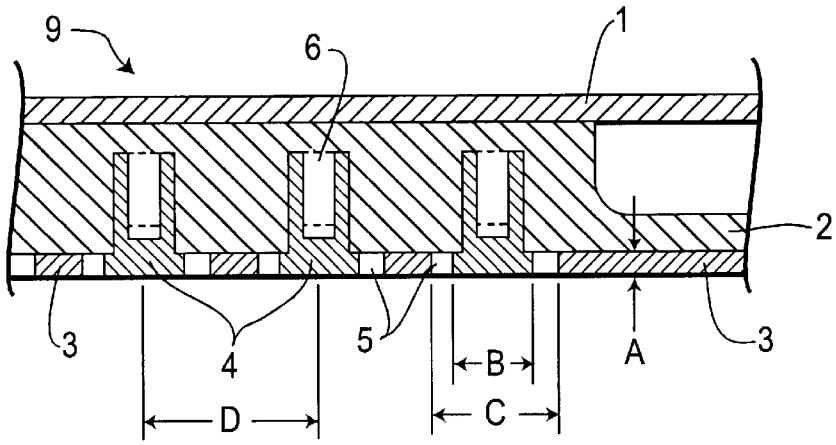
FIG. 7 shows an exemplary electrostatic chuck.

FIG. 7 shows a cross-section of a coplanar chuck 9 where deposition electrodes 4 are separated from shield electrodes 3 by dielectric (preferably atmosphere) 5, with these features seated in base material 2. The deposition electrodes 4 are preferably formed of series 300 stainless steel. Deposition electrodes 4 contain a pin receptacle 6 for connection to circuit board 1. Base material 2 is made of a dielectric such as Noryl® polymer (GE Plastics, Pittsfield, Mass.). Noryl engineered plastics are modified polyphenylene oxide, or polyphenylene oxide and polyphenylene ether, resins. The modification of these resins involves blending with a second polymer such as polystyrene or polystyrene/butadiene. By varying the blend ratio and other additives, a variety of grades are produced. Unmodified, these polymers are characterized by regular closely spaced ring structures (phenyl groups) in the main molecular chain. This feature along with strong intermolecular attraction causes extreme stiffness and lack of mobility. The shield electrodes 3 can be made from a conductive material (such as 300 series stainless steel) adhered to the base material 2, for example by an adhesive or a double-sided, rubber-based adhesive tape. The annular gaps that are the preferred embodiment of dielectric 5 can be made by drilling a series of holes in the conductor layer that will form the shield electrodes 3. The deposition electrodes 4 can be, for example, pressed or glued into the base material. The assembly is preferably ground to create a flat, coplanar surface, for example within a tolerance of 0.0002 inches. Where dielectric 5 is atmosphere (that atmosphere in which the electrostatic chuck operates), preferably the portion of the dielectric separation of the electrodes comprising atmosphere is sufficient so that in use the upper plane of the electrostatic chuck aligned with dielectric 15 discharges completely between depositions. Such an amount of dielectric separation is "substantial" separation.

Such an electrostatic chuck can be simply modified with the techniques described to incorporate electrically isolated shield electrodes that can be separately connected to control electronics to provide the sensing circuits described above. Dimension A can be, for example, 0.01 inch; Dimension B can be, for example, 0.157 inch; Dimension C can be, for example, 0.236 inch; Dimension D, the pitch between pixels, can be, for example, 0.3543 inch. The electrostatic chuck can be operated, for example, with a voltage of ~700 or ~1,400 V applied to the deposition electrodes.

Figure 8A:
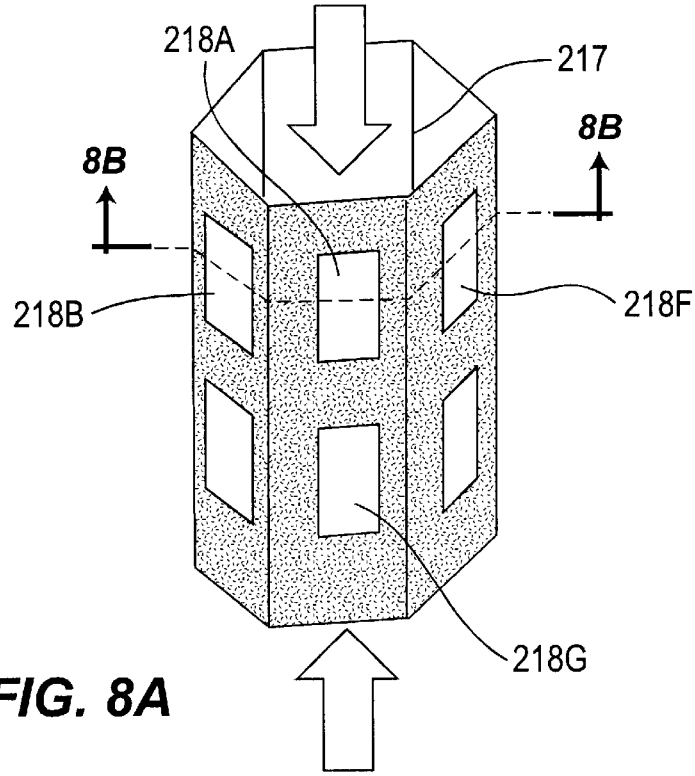
FIGS. 8A and 8B show a perspective and cut-away view (respectively) of a deposition chamber with multiple deposition openings.
Figure 8B:
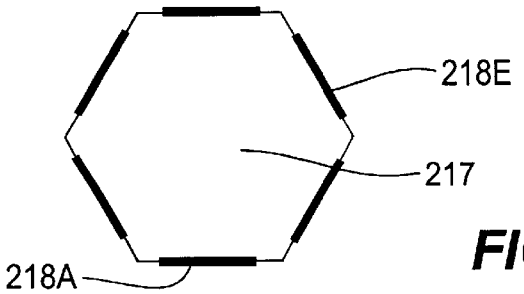

Another embodiment provides tools for higher throughput. As illustrated in FIG. 8A, the deposition openings 218 (e.g., as illustrated, deposition openings 218A–218L) can be positioned around a circular or oval, or multi-faceted (as illustrated) deposition chamber 217. The deposition chamber 217 is preferably oriented vertically (i.e., along the gravity vector). Particles can be introduced by bulk flow in one of the directions indicated with the schematic arrows, or through a nozzle (not shown). Suitable nozzles include nozzles adapted to direct particles at all the deposition openings, or nozzles that rotate between positions adapted to direct powder at a subset of deposition openings. As illustrated, there can be several tiers of depositions openings, or there can be one tier. Where the deposition chamber 217 is circular or oval, the electrostatic chucks that fit at the deposition openings can be fitted with adaptive fittings, or the electrostatic chucks can be appropriately rounded to match the rounded openings or rounded fittings for such openings. FIG. 8B shows a cut-away view. Though not illustrated, the deposition chamber can be fitted with an upper wall (e.g., where the upper arrow in FIG. 8A is found), which in turn can be fitted with one or more deposition openings.

Figure 9A:
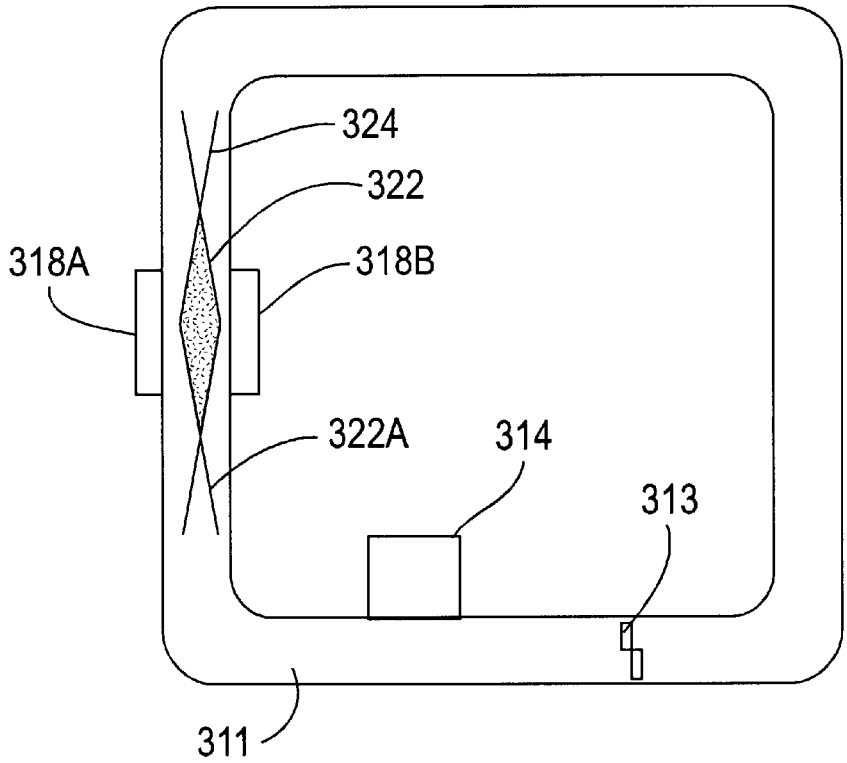
FIGS. 9A and 9B show re-circulating particle feed apparatuses incorporating multiple deposition openings.
Figure 9B:
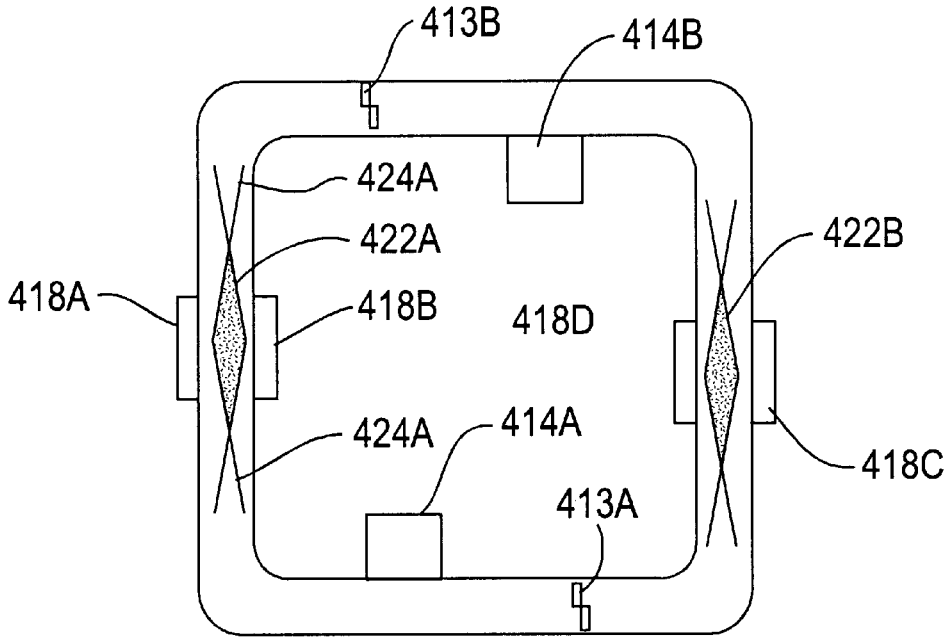

FIGS. 9A and 9B illustrate that other above-described features of the invention can be used with this embodiment. Thus, deposition opening 318A and 318B can be positioned in a re-circulating particle feed apparatus 300, with a powder source 314, a device for providing powder flux 313, and a diverting vane 322. Diverting vane 322 can be a solid or hollow element, shaped as appropriate to divert powder towards the deposition openings, and can be positioned in conduit 311 by braces such as braces 324. FIG. 9B shows re-circulating particle feed apparatus 400, which has additional locations for deposition openings 418, and optionally other features numbered correspondingly to the numbering of FIG. 9A, with the numbers advanced by 100. Other powder feeding devices can be used, such as the other devices described above or in other patents or patent applications cited herein.

GLOSSARY

The following definitions are provided to facilitate understanding of certain terms used frequently herein:

A "deposition surface of the chuck" is a surface designed for electro-attractive deposition on selected surfaces thereof, or on corresponding surfaces of a substrate mounted on the deposition surface.

"Electro-attractive deposition" refers to methods that use electrical forces to attract or deposit charged particles to a surface.

An "expansion chamber" of a piston device is the chamber, typically a cylinder, that expands and contracts due to the outward and inward stroke of the piston.

"Particles" are, for the purposes of this application, aggregates of molecules, typically of at least about 3 nm average diameter, such at least about 500 nm or 800 nm average diameter, and are preferably from about 100 nm to about 5 mm, for example, about 100 nm to about 500 $\mu$m. Particles are, for example, particles of a micronized powder, or polymer structure that can be referred to as "beads." Beads can be coated, have adsorbed molecules, have entrapped molecules, or otherwise carry other substances.

A "range of electro-attractive influence at the deposition station" is a range at which an electrostatic chuck docked at the deposition station, optionally in conjunction with ancillary electrically powered focusing screens or electrodes at the deposition station, influences particles towards a selected site of deposition (typically on a substrate loaded on the electrostatic chuck.

The invention described herein can be used in conjunction with a number of devices and methods described by applicants or those working with applicants. For example, the "Electrostatic Sensing Chuck Using Area Matched Electrodes" application of Sun et al., U.S. Pat. No. 6,370,005, and the "Device for the Dispersal and Charging of Fluidized Powder" application of Sun et al., U.S. Pat. No. 6,491,241 can be used in conjunction with the invention. Other devices or methods that can be used with various aspects of the present invention include, for example, the methods for use of transporter chucks, acoustic bead dispensers and other powder-manipulating devices set forth in Sun, "Chucks and Methods for Positioning Multiple Objects on a Substrate," U.S. Pat. No. 5,788,814, issued Aug. 4, 1998; Sun et al., "Electrostatic Chucks and a Particle Deposition Apparatus Therefor," U.S. Pat. No. 5,858,099, issued Jan. 12, 1999; Pletcher et al., "Apparatus for Electrostatically Depositing a Medicament Powder Upon Predefined Regions of a Substrate," U.S. Pat. No. 5,714,007, issued Feb. 3, 1998 (see, also U.S. Pat. No. 6,007,630, issued Dec. 28, 1999); Sun et al., "Method of Making Pharmaceutical Using Electrostatic Chuck," U.S. Pat. No. 5,846,595, issued Dec. 8, 1998; Sun et al., "Acoustic Dispenser," U.S. Pat. No. 5,753,302, issued May 19, 1998; Sun, "Bead Transporter Chucks Using Repulsive Field Guidance," U.S. Pat. No. 6,098,368, issued Aug. 1, 2000; Sun, "Bead Manipulating Chucks with Bead Size Selector,", U.S. Pat. No. 5,988,432, issued Nov. 23, 1999; Sun, "Focused Acoustic Bead Charger/Dispenser for Bead Manipulating Chucks," U.S. Pat. No. 6,168,666, issued Jan 2, 2001; Sun et al., "AC Waveforms Biasing For Bead Manipulating Chucks," U.S. Pat. No. 6,149,774, issued Nov. 21, 2000; Sun et al, "Method for Clamping and Electrostatically Coating a Substrate," U.S. Pat. No. 6,399,143; Poliniak et al., "Dry Powder Deposition Apparatus," U.S. Pat. No. 6,063,194, issued May 16, 2000; and "Pharmaceutical Product," U.S. Pat. No. 6,303,143. Additional powder-handling devices, including a cone-shaped cloud chamber, are described in O'Mara et al., "Article Comprising a Diffuser with Flow Control Features," U.S. Pat. No. 6,444,033.

All publications and references, including but not limited to patents and patent applications cited in this specification are herein incorporated by reference in their entirety as if each individual publication or reference were specifically and individually indicated to be incorporated by reference herein as being fully set forth. Any patent application to which this application claims priority is also incorporated by reference herein in its entirety in the manner described above for publications and references.

While this invention has been described with an emphasis upon preferred embodiments, it will be obvious to those of ordinary skill in the art that variations in the preferred devices and methods may be used and that it is intended that the invention may be practiced otherwise than as specifically described herein. Accordingly, this invention includes all modifications encompassed within the spirit and scope of the invention as defined by the claims that follow.

What is claimed:

1. A re-circulating particle feed apparatus comprising:

(a) a cyclic conduit of dimensions suitable for circulating gas with suspended particles;

(b) a deposition station comprising at least one opening onto the conduit, into which opening an electrostatic chuck fits, with a deposition surface of the chuck available to the interior of the conduit; and (c) a propulsion device for maintaining fluid and particle circulation through the conduit, wherein the propulsion device is adapted to maintain fluid and particle circulation at a rate that brings a deposition effective amount of particles within a range of electro-attractive influence at the deposition station.

2. The re-circulating particle feed apparatus of claim 1, further comprising one or more vanes positioned within the conduit and adapted to direct particles toward the deposition station.

3. The re-circulating particle feed apparatus of claim 1, wherein the propulsion device comprises a Venturi into which gas and suspended particles in the circuit are drawn and external gas is injected.

4. The re-circulating particle feed apparatus of claim 3, wherein replacement particles are inserted into the conduit with the external gas injection.

5. The re-circulating particle feed apparatus of claim 1, further comprising (d) an airlock through which particles are inserted into the conduit.

6. The re-circulating particle feed apparatus of claim 1, wherein the deposition station comprises two or more said openings.

7. A reciprocating particle feed apparatus comprising:

(1) a deposition chamber;

(2) a deposition station comprising an opening onto the deposition chamber, into which opening an electrostatic chuck fits, with a deposition surface of the chuck available to the interior of the deposition chamber, the dimensions of the deposition chamber suitable for presenting a deposition effective amount of particles suspended therein within a range of electro-attractive influence at the deposition station; and (3) at least one piston device comprising a piston and an expansion chamber connected to the deposition chamber, the piston device for supplying movement of gas into and out of the deposition chamber for maintaining particle suspension in the deposition chamber.

8. The reciprocating particle feed apparatus of claim 7, comprising:

(4) two or more of the piston devices, wherein each piston device is adapted to so that each of its inward strokes is offset by reciprocal strokes from pistons of other piston devices.

9. The reciprocating particle feed apparatus of claim 7, further comprising:

(5) one or more expansion devices adapted to allow the enclosed volume connected to the deposition chamber to expand when inward piston strokes of the piston devices would contribute to a compression of that volume.

10. A re-circulating particle feed apparatus comprising:

(a) a cyclic conduit of dimensions suitable for circulating gas with suspended particles at a deposition appropriate density;

(b) a deposition station comprising at least one opening onto the conduit, into which opening an electrostatic chuck fits, with a deposition surface of the chuck available to the interior of the conduit; and (c) a propulsion device for maintaining fluid and particle circulation through the conduit, wherein the propulsion device is adapted to maintain fluid and particle circulation at a rate that brings a deposition effective amount of particles within a range of electro-attractive influence at the deposition station.

11. The re-circulating particle feed apparatus of claim 10, further comprising one or more vanes positioned within the conduit and adapted to direct particles toward the deposition station.

12. The re-circulating particle feed apparatus of claim 10, wherein the propulsion device comprises a Venturi into which gas and suspended particles in the circuit are drawn and external gas is injected.

13. The re-circulating particle feed apparatus of claim 12, wherein replacement particles are inserted into the conduit with the external gas injection.

14. The re-circulating particle feed apparatus of claim 10, further comprising (d) an airlock through which particles are inserted into the conduit.

15. The re-circulating particle feed apparatus of claim 10, wherein the deposition station comprises two or more said openings.

* * * * *